US006684587B2

(12) United States Patent
Shaw et al.

(10) Patent No.: US 6,684,587 B2
(45) Date of Patent: Feb. 3, 2004

(54) CEDAR IMPRESSION SIDING CORNER

(75) Inventors: Robert David Shaw, Parma, MI (US); Stephen William Steffes, McPherson, KS (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 10/170,819

(22) Filed: Jun. 20, 2002

(65) Prior Publication Data

US 2002/0162291 A1 Nov. 7, 2002

Related U.S. Application Data

(63) Continuation of application No. 09/796,930, filed on Mar. 1, 2001.

(51) Int. Cl.[7] ..... E04B 2/00; E04D 1/00

(52) U.S. Cl. ..... 52/288.1; 52/532

(58) Field of Search ..... 52/287.1, 288.1, 52/716.1, 718.04, 717.05, 536, 555, 278, 532

(56) References Cited

U.S. PATENT DOCUMENTS

| | | | | | |
|---|---|---|---|---|---|
| 2,255,247 | A | * | 9/1941 | Gabriel | 52/278 |
| 2,607,449 | A | * | 8/1952 | Daniels | 52/553 |
| 2,821,754 | A | | 2/1958 | Hillson | 52/288.1 |
| 3,289,380 | A | | 12/1966 | Charniga | |
| 3,500,600 | A | | 3/1970 | Bagley, Sr. | 52/288.1 |
| 3,651,610 | A | | 3/1972 | Donahue | |
| 3,828,499 | A | | 8/1974 | Leddy | |
| 4,015,391 | A | | 4/1977 | Epstein et al. | 52/520 |
| 4,864,787 | A | * | 9/1989 | Bukowski | 52/284 |
| 5,347,784 | A | | 9/1994 | Crick | |
| 5,836,123 | A | | 11/1998 | Gulino | 52/288.1 |
| D402,879 | S | | 12/1998 | Beard, Jr. | D25/102 |
| D454,648 | S | * | 3/2002 | Shaw et al. | D25/139 |
| D456,089 | S | * | 4/2002 | Shaw et al. | D25/139 |
| 2002/0121057 | A1 | * | 9/2002 | Steffes et al. | 52/287.1 |

OTHER PUBLICATIONS

Hand–Split Shake brochure, Nailite International , Miami, Florida (date unknown).
Perfection–Plus Cedar brochure, Nailite International , Miami, Florida (date unknown).
PCT International Search Report dated Dec. 3, 2002.

* cited by examiner

*Primary Examiner*—Carl D. Friedman
*Assistant Examiner*—Kevin McDermott
(74) *Attorney, Agent, or Firm*—Duane Morris LLP

(57) ABSTRACT

A corner piece includes a first group of vertically stacked walls and a second group of vertically stacked walls is provided. Each wall in the first and second groups includes an exterior face and an interior face and a first lateral edge and a second lateral edge opposite the first lateral edge. The first group and second groups meet at a common corner defined by the first lateral edges. The exterior faces collectively include an ornamental appearance containing a plurality of vertically stacked shingle impressions. The second lateral edges of the walls in at least one of the groups are staggered in width relative to the common corner, wherein the shingle impressions of the at least one group overlap at least a portion of the siding panels when the siding panels and the corner piece are fastened to the structure.

25 Claims, 12 Drawing Sheets

CEDAR IMPRESSION SIDING CORNER

CROSS-REFERENCE TO RELATED APPLICATION

This application is a continuation of U.S. patent application Ser. No. 09/796,930 of Robert David Shaw and Stephen William Steffes, filed Mar. 1, 2001, entitled "Cedar Impression Siding Corner" the entirety of which is hereby incorporated herein by reference.

FIELD OF THE INVENTION

This invention relates to siding products generally, and more particularly to siding corners having cedar impressions formed thereon.

BACKGROUND OF THE INVENTION

Wooden shingles and shakes are very popular and attractive siding products used in the construction of homes, businesses and other structures. Unfortunately, these wooden products require constant maintenance, and are extremely expensive, as well as labor intensive to install. Further, the durability of wooden products, such as those constructed from cedar, lags far behind that of products made of synthetic materials. Therefore, a considerable number of synthetic siding products have been created that simulate the wooden appearance of, for example, cedar shingles or cedar shake shingles. These siding products are typically formed from materials such as polyvinyl chloride and polypropylene.

Once siding panels are installed onto the exterior sheathing of a structure, it often becomes necessary to place a corner cap over the exposed ends of the siding panels. Efforts have been made to match the ornamental appearance of the siding panel with the corner cap appearance, so as to avoid an unaesthetic or artificial looking final structure. One example is the simulated shake siding corner described in U.S. Pat. No. 4,015,391 to Epstein, et al. entitled "Simulated Cedar Shake Construction," issued Apr. 5, 1977, the entirety of which is hereby incorporated by reference herein. Epstein describes simulated cedar shake siding panels that are attached to the outside walls of a structure and a corner piece 70 that may be used in conjunction with the described siding panels.

The Epstein corner 70, illustrated in FIGS. 1A through 1F, is formed with a shake impression thereon in order to match the shake appearance provided by the siding panels, also described in Epstein and shown in FIG. 1F. The siding corner 70 simulates two shakes 71, 73 nailed or otherwise mitre attached at about 90°, one to the other. The corner piece 70 is formed with the horizontal base 72 approximating in size the normal depth of natural shakes. A vertical lip 74 extends from the inside edge of horizontal base 72 and locks two overlapping corners 70 when it engages slot receptor 80 formed between the base of nose 78 and planes of the pre-apertured nailing tab 76. Two corners 70 may be interfitted butt-end to head-end when the lip 74 is received inside slot receptor 80, as illustrated in FIG. 1C. The shake faces 71, 73 are angled forward from top to bottom so that the lip 74 can enter slot receptor 80 of the next lowest corner 70. The nailing tab 76 seats against the wall surfaces and may be nailed thereto. FIG. 1F is a plan view of a siding facade including a plurality of stacked corners 70, one on top of the other, with the shake faces 71,73 overlapping the side edges of simulated shake panels 97,95,91,93 nailed to two walls of a structure.

FIG. 2A of the Epstein '391 patent is a front perspective view of another prior art multiple course simulated cedar shake corner piece 100, and FIG. 2B is a right side elevational view of the corner of FIG. 2A. The corner piece 100 includes two faces 102, 104 having a pair of vertically stacked shingle impressions thereon. The corner piece 100 includes two nailing flanges 106, 108. The corner piece 100 is nailed to a corner of a structure prior to attaching siding panels, which overlap the nailing flanges 108, 106 of the corner piece 100.

Prior art corner pieces, such as corner pieces 70, 100 described above, suffer from several drawbacks. First, referring to FIG. 1F, when viewing a corner of a structure covered by a stack of a plurality of corner pieces 70 such that both walls of the structure that form the corner are visible, the appearance of a random selection of shingles within each course formed on the siding panels does not continue through to the corner pieces 70 when the corner pieces 70 each have identical faces 71, 73. The courses do not appear as if they terminate in a natural manner at the corners of the structure. This unnatural appearance occurs when employing either the multiple course corner piece 100, where the faces 102, 104 are identical, or when employing the single course corner piece 70, where the faces 71, 73 are identical.

Further, as best illustrated in FIG. 2B, when viewing only a single wall of a structure that includes a prior art corner piece 70 or a prior art corner piece 100, it becomes quite apparent that artificial corner pieces have been employed. A continuous and non-staggered lateral edge 110 is apparent along the entire corner of the structure from corner piece 70, 100 to corner piece 70, 100 when corner pieces 70, 100 are attached to the structure in a vertical stack, one on top of the other. The linear joint formed between the siding corner pieces and the siding panels is apparent to even a casual observer.

Therefore, there remains a need for a corner piece that provides the appearance of a more natural termination of the courses of a siding facade employing simulated cedar impression siding panels and for a corner piece that more effectively blends the corner piece into the facade to mask the presence of the corner piece and promote the overall desired appearance of a random selection of individual shingles.

SUMMARY OF THE INVENTION

The present invention provides a corner piece for covering a corner of a structure defined by two mating walls of the structure and for use in conjunction with siding panels containing multiple shingle impression courses fastened to the mating walls. The corner piece includes a first group of vertically stacked walls and a second group of vertically stacked walls, each wall in the first and second groups including an exterior face and an interior face and a first lateral edge and a second lateral edge opposite the first lateral edge. The first group and second group meet at a common corner defined by the first lateral edges. The exterior faces collectively include an ornamental appearance containing a plurality of vertically stacked shingle impressions. The second lateral edges of the walls in at least one of the groups are staggered in width relative to the common corner, wherein the shingle impressions of the at least one group overlap at least a portion of the siding panels when the siding panels and the corner piece are fastened to the structure.

The shingle impressions and the multiple shingle impression courses of the siding panels cooperate to give the appearance that the corner piece substantially blends into the siding panels. The corner piece provides a natural looking termination to the courses of the siding panels when viewing the structure from the side (i.e., when only one of the walls is visible) or when viewing the corner of the structure (i.e., when both of the walls of the structure are visible). No linear seem or joint is conspicuously formed between the corner piece and the siding panels, thereby masking the presence of a prefabricated and artificial corner member.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention as well as other information pertinent to the disclosure, in which.

DETAILED DESCRIPTION OF THE INVENTION

Figure 3A:
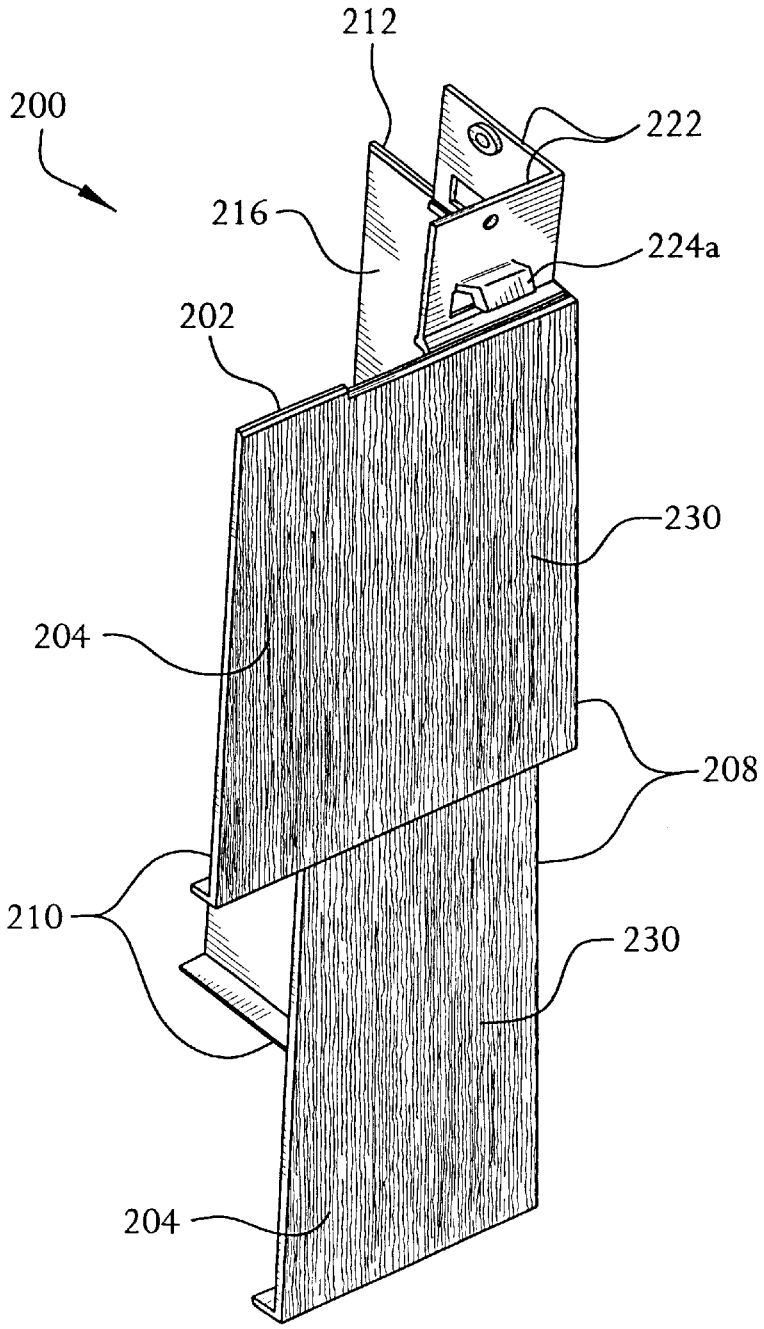
FIG. 3A is a side perspective view of an exemplary outside corner piece according to the present invention.
Figure 3B:
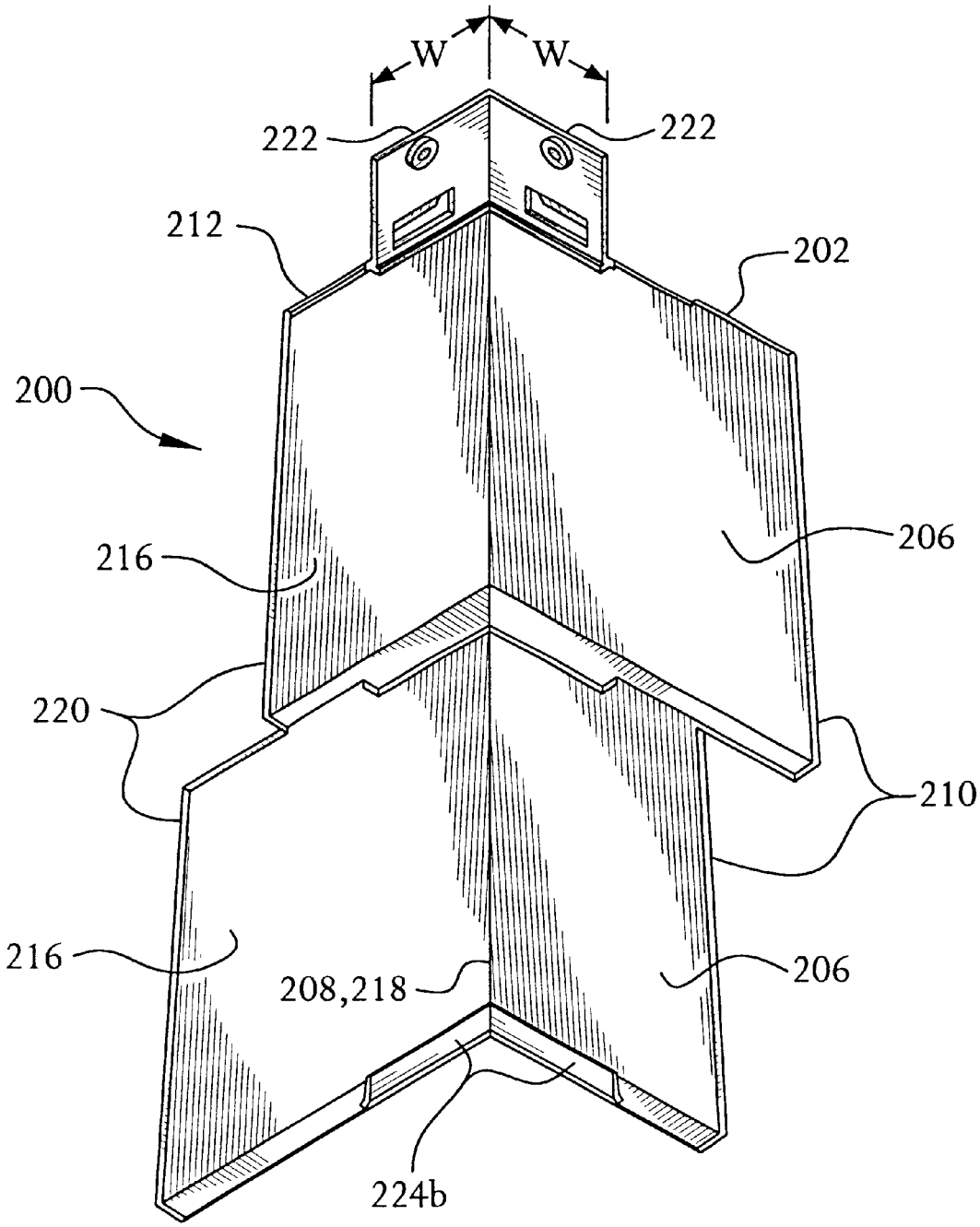
FIG. 3B is a rear perspective view of the exemplary corner piece of FIG. 3A.

FIGS. 3A–3E illustrates an exemplary embodiment of an outside corner piece 200 for covering an "outside corner" of a structure. Specifically, FIG. 3A is a side perspective view of the outside corner piece 200. By "outside" corner piece, it is meant that the corner piece is shaped to cover an outwardly protruding or "outside" corner of a structure as opposed to an inwardly formed or "inside" corner of a structure, as may be covered by the inside corner piece 300 shown in FIGS. 4A–4E.

The outside corner piece 200 includes a first wall 202 and a second wall 212. The first wall 202 is defined by an exterior face 204, an interior face 206, a first lateral edge 208 and a second lateral edge 210. Likewise, the second wall 212 is defined by an exterior face 214 (shown in FIG. 3D), an interior face 216, a first lateral edge 218 and a second lateral edge 220. The second wall 212 meets the first wall 202 at a corner defined by the first lateral edges 218, 208 of the second wall 212 and first wall 202, respectively.

The exterior faces 204, 214 of the first and second walls 202, 212 each include an ornamental appearance containing a plurality of vertically stacked siding impressions formed thereon; preferably, a plurality of vertically stacked shingle impressions formed thereon; and more preferably, a plurality of vertically stacked cedar shingle impressions 230 formed thereon. Detailed impressions may be formed on the exterior faces 204, 214 by injection molding the corner piece 200. The preferred materials for forming the corner piece 200 include polyvinyl chloride (PVC) and polypropylene, although other materials such as cement, wood-polymer blends, etc. may also be suitable. The vertically stacked shingle impressions preferably match and align with the courses formed on the siding panels attached to the walls of the structure. By "course," it is meant a continuous horizontal siding layer of brick, masonry or shingle.

An exemplary outside corner piece 200 preferably includes fastening means for attaching the corner piece 200 to the corner of the structure. Siding panels that also include a shingle impression are attached to the walls of the structure, such as in a conventional nailing fashion and preferably before attaching corner pieces 200. Once the siding panels are attached to the walls of the structure, a first corner piece 200 may be disposed at the bottom-most end of the corner of the structure. The siding panels are disposed to leave the corner of the structure partially uncovered, at least enough to accommodate the width, designated "W" in FIG. 3B, of the nailing flanges 222 described hereafter. The corner piece 200 may then be attached to the corner of the structure using the fastening means. An exemplary fastening means includes at least one nailing flange 222 extending from the first and second walls 202, 212. The nailing flanges 222 are preferably pre-apertured as shown in FIGS. 3A–3E in order to facilitate attachment to the structure.

Once a corner piece 200 is attached to a corner of a structure as described above, a second corner piece 200 may be attached above the first corner piece 200 such that the bottom end of the second corner piece 200 is fitted over the top end of the first corner piece 200 as described hereafter. An exemplary corner piece 200 preferably includes cooperable catch means for securing corner pieces together. A second corner piece 200 may be fitted over a first corner piece 200 such that catches 224*b* disposed toward the bottom end of the second corner piece 200 fit into catches 224*a* disposed toward the top end of the first corner piece 200. The second corner piece 200 may then be nailed to the corner of the structure as described above. This assembly technique may be followed until the entire corner of the structure is covered by stacked corner pieces 200.

It should be apparent that the bottom of the second corner piece 200 covers the nailing flange 222 of the corner piece 200 immediately below it. The corner pieces 200 are also preferably attached to the corner such that the second lateral edges 210, 220 overlap at least a portion of the siding panels when the siding panels and corner piece 200 are attached to the structure. The siding panels are preferably attached, such as by nailing flanges, to the walls of the structure prior to attaching the corner pieces 200, but the siding panels may also be attached to the walls of the structure after attachment of the corner pieces 200 if the edges of the siding panels are slid under the second lateral edges 210, 220 of the corner pieces 200.

An exemplary corner piece 200 may be approximately 14" tall, although the present invention is in no manner limited to a specific size of corner piece. This exemplary size of corner piece 200 may be manufactured in a conventional injection molding process. Each shingle impression of the plurality of vertically stacked shingle impressions 230 of exemplary corner piece 200, therefore, is approximately 7" tall and designed to align with the courses of the siding panels. An exemplary corner piece 200 is also preferably approximately 0.125" or less in thickness, designated "T" in FIG. 3E, such that the walls 202, 212 of the corner piece 200 do not significantly protrude from the faces of the siding panels when covering at least a portion of the siding panels.

Figure 1A:
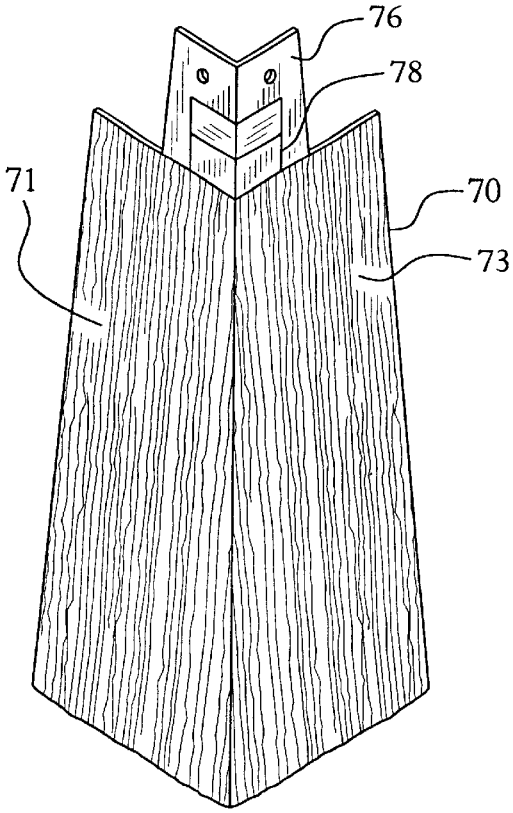
FIG. 1A (PRIOR ART)
FIG. 1A is a front perspective view of a prior art siding corner.
Figure 1B:
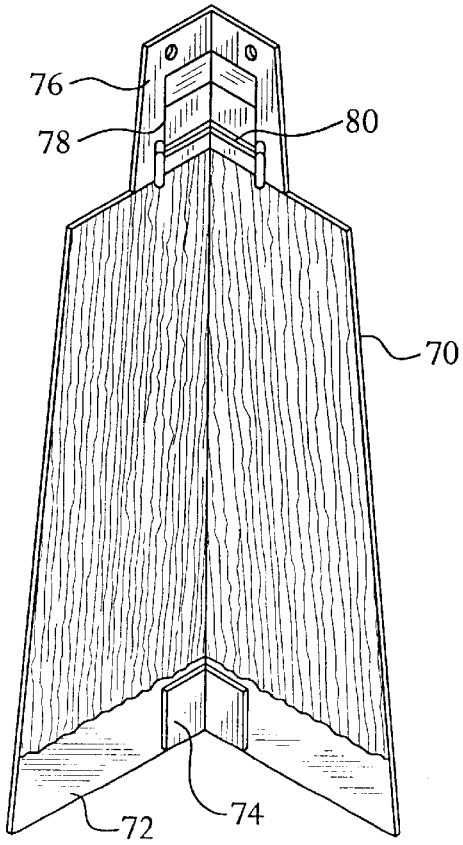
FIG. 1B (PRIOR ART)
FIG. 1B is a rear perspective view of the prior art siding corner of FIG. 1B.
Figure 1D:
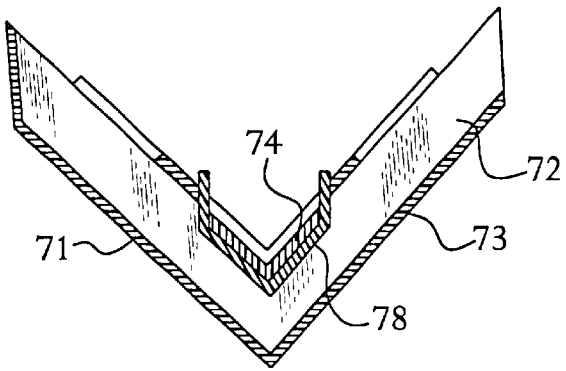
FIG. 1D (PRIOR ART)
FIG. 1D is an enlarged fragmentary section taken along line 1D—1D of FIG. 1F.
Figure 1E:
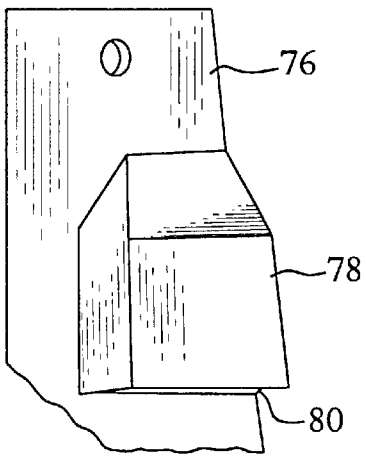
FIG. 1E (PRIOR ART)
FIG. 1E is an enlarged view of the corner to corner locking means of the prior art siding corner of FIG. 1A.
Figure 1C:
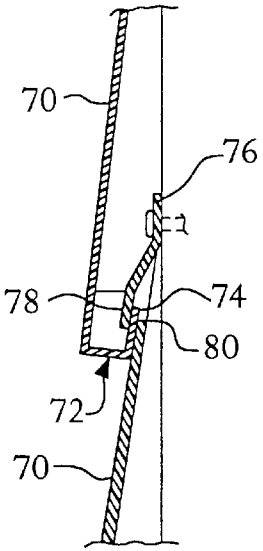
FIG. 1C (PRIOR ART)
FIG. 1C is an enlarged fragmentery section taken along line 1C—1C of FIG. 1F.
Figure 1F:
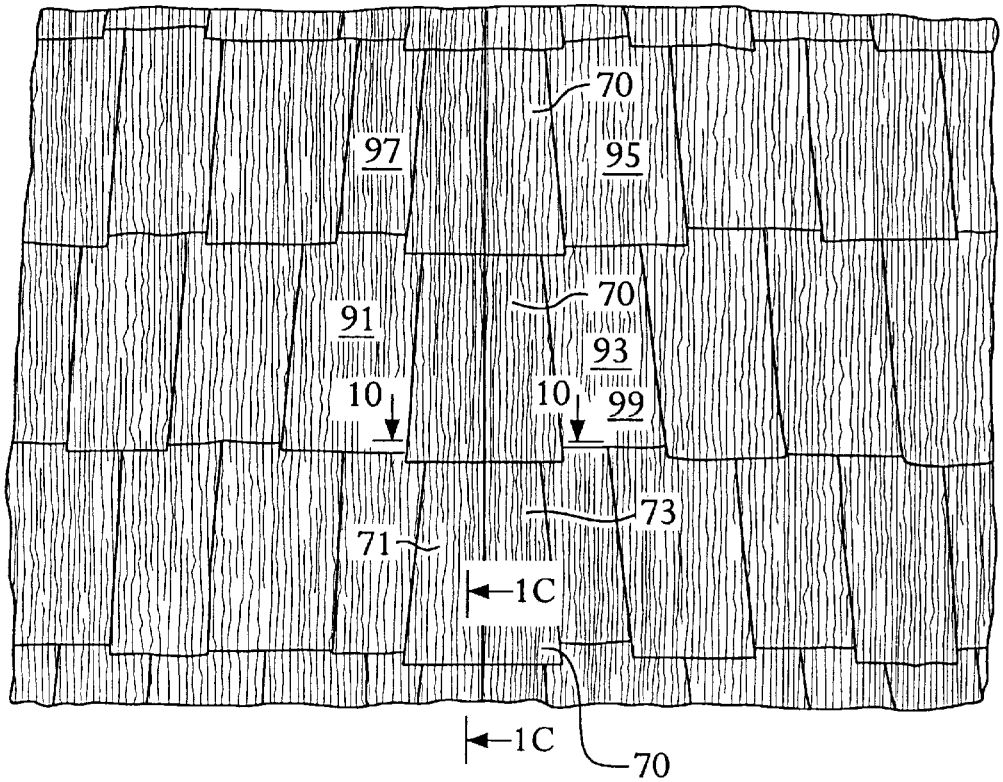
FIG. 1F (PRIOR ART)
FIG. 1F is a plan view of prior art simulated shake corners of FIG. 1A and panels in an assembled form.
Figure 2A:
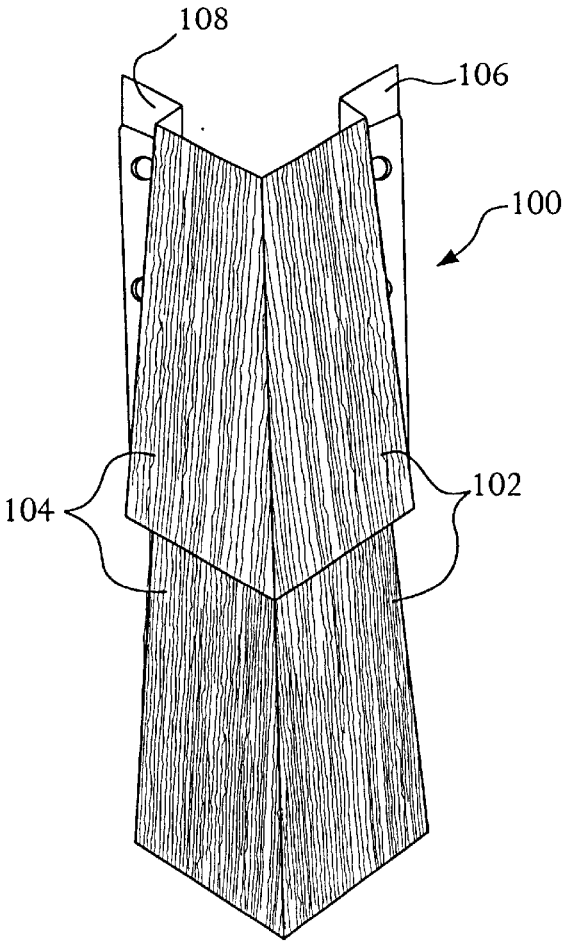
FIG. 2A (PRIOR ART)
FIG. 2A is a front perspective view of a prior art siding corner having a vertically stacked shingle impression thereon.

This exemplary corner piece 200 provides several benefits. The corner piece 200 may be attached to the corner of the structure after attaching the siding panel, as opposed to the prior art corner piece 100 shown in FIGS. 2A and 2B which must be attached to the corner of the structure prior to the attaching the siding panels. This feature, therefore, allows a damaged siding corner piece 200 or plurality of damaged siding corner pies 200 to be removed without the added labor associated with removing and reattaching the siding panels of the attached to the structure.

Figure 3D:
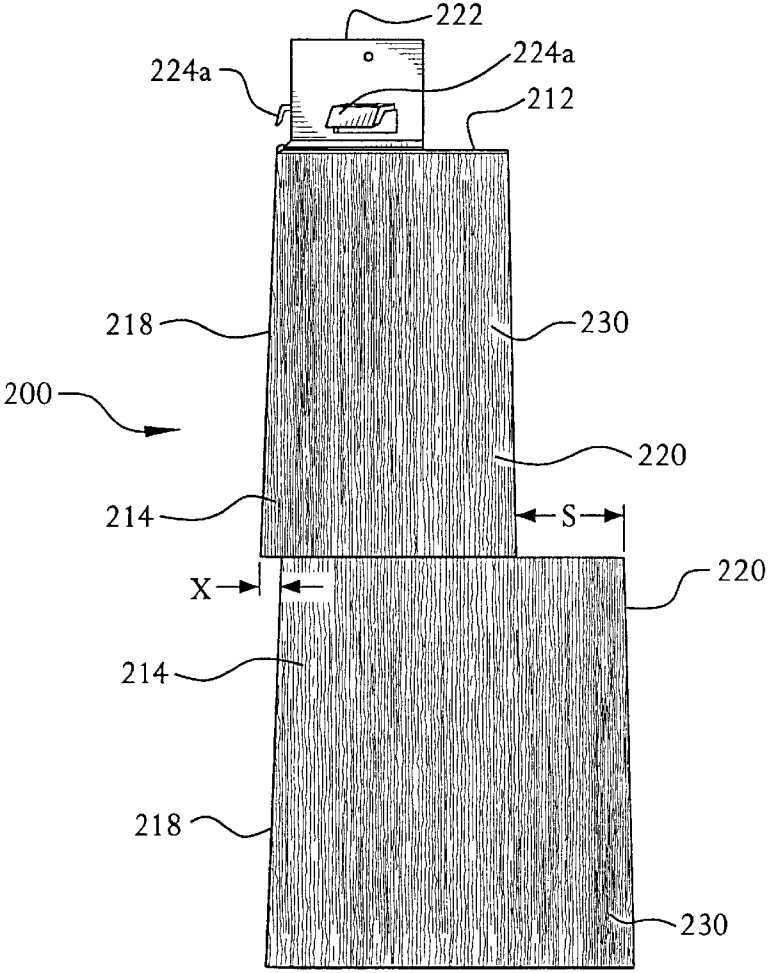
FIG. 3D is a second outside side elevational view of the exemplary corner piece of FIG. 3A.
Figure 3C:
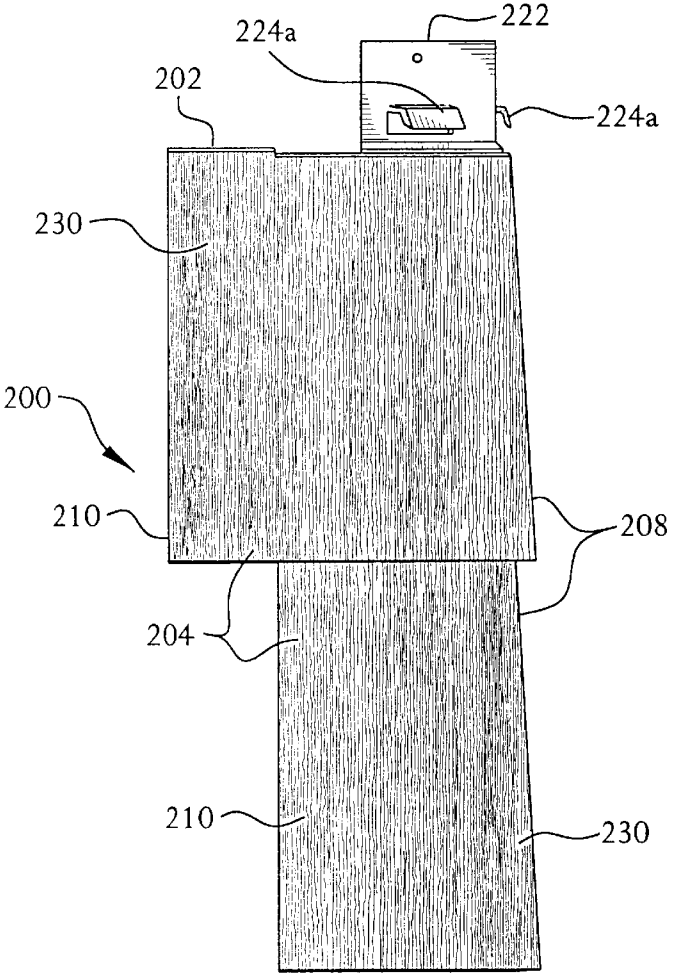
FIG. 3C is a first outside side elevational view of the exemplary corner piece of FIG. 3A.
Figure 3E:
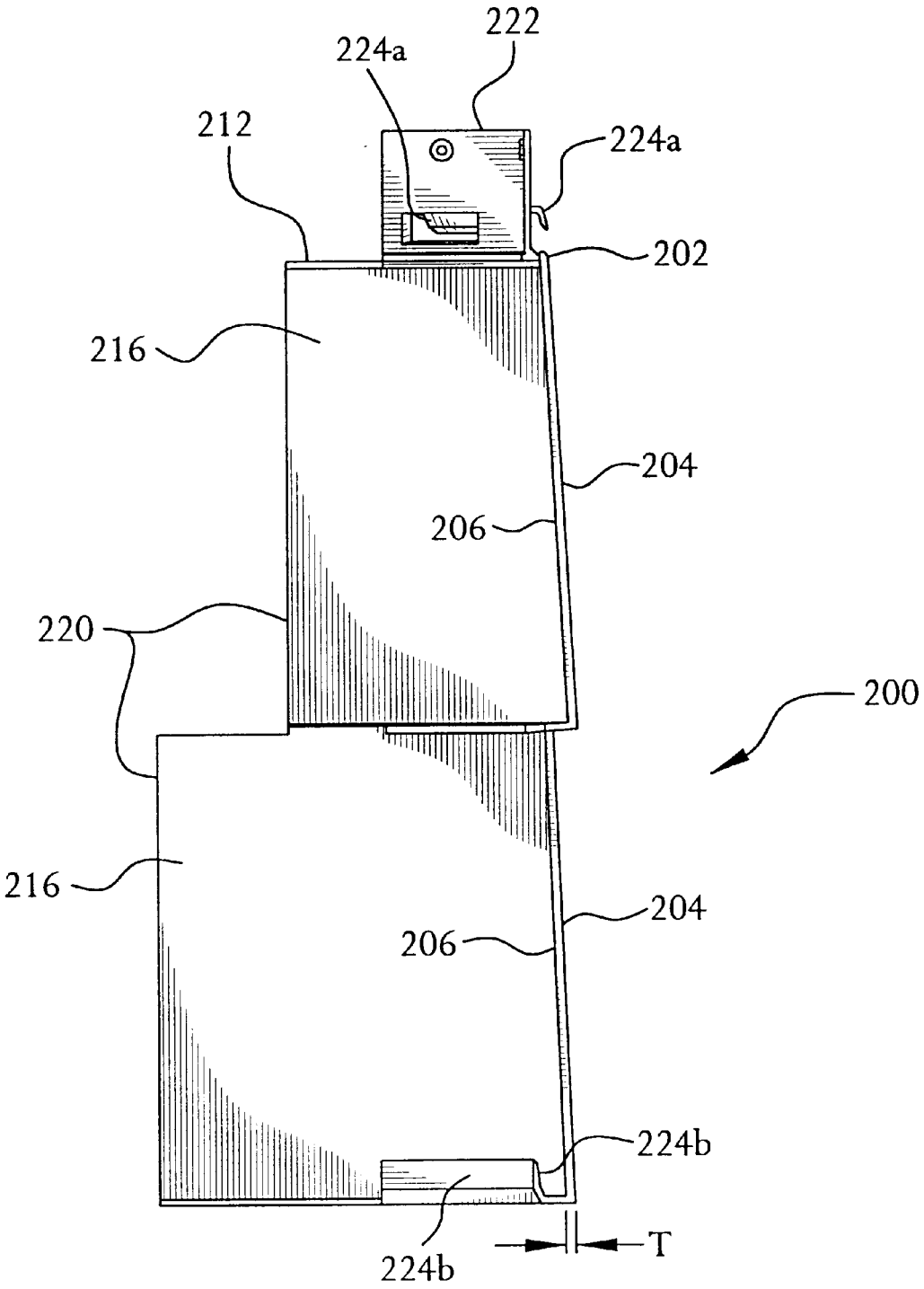
FIG. 3E is an inside side elevational view of the exemplary corner piece of FIG. 3A.

Also, as can be seen in FIGS. 3A–3E, the shingle impression of the exterior faces 204, 214 are staggered at least along the second lateral edges 210, 220. By "staggered," it is meant that the second lateral edges of two vertically stacked shingle impressions are offset a distance from each other where the bottom of a first vertically stacked shingle impression meets the top of a second vertically stacked shingle impression such that one of the shingle impressions effectively extends to overlap a greater portion of a siding panel attached to the structure when the siding panel and corner piece 200 are attached to the structure. For example, the second lateral edges 210, 220 of each shingle impression 230 shown in FIG. 3D are offset a distance "S". This distance "S" (shown in FIG. 3D), for example, may be an approximately 1.5" to 2.0" offset.

Figure 2B:
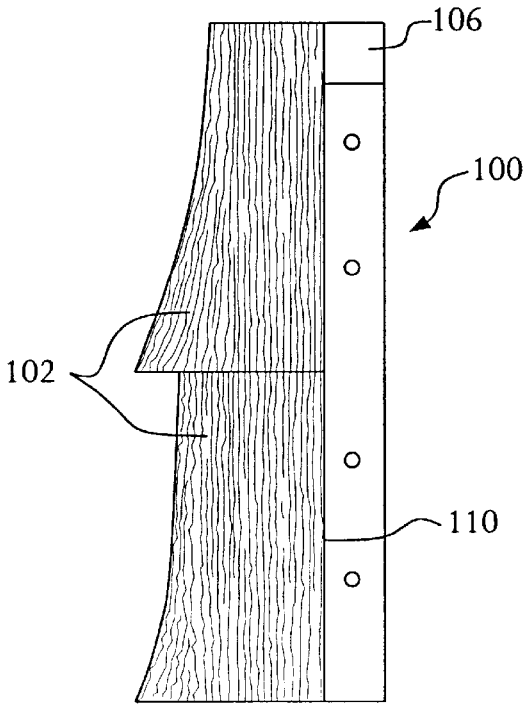
FIG. 2B (PRIOR ART)
FIG. 2B is a right side elevational view of the prior art siding corner of FIG. 2A.

These vertically stacked shingle impressions align with the courses of the siding panels and overlap at least a portion of the siding panels. The staggered edges 210, 220 effectively hide the intersection between a stack of corner pieces 200 and the siding panels, and no continuous straight line intersection, as described above in connection with the prior art corner piece 100 and shown in FIG. 2B, is formed. The second lateral edges 210, 220 cooperate with the plurality of vertically stacked shingle impression 230 to give the appearance that the corner piece(s) substantially blend into the adjacent siding panels and continue the shingle courses formed thereon. No seam between the siding panels and the corner pieces 200 is discernible.

The exterior faces 204, 214 of an exemplary corner piece 200 are also preferably angled from top to bottom as shown in FIGS. 3A–3E along each of the plurality of vertically stacked shingle impressions formed thereon. The bottom edge of a first shingle impression 230 is offset a distance designated as "X" in FIG. 3D from the top edge of a second shingle impression 230 stacked below the first, as shown in FIG. 3D. This offset creates the appearance that the bottom edge of the first shingle impression overlaps the top edge of the second shingle impression and also creates an aesthetic shadow effect. An exemplary offset distance "X" is approximately 0.375".

Figure 4A:
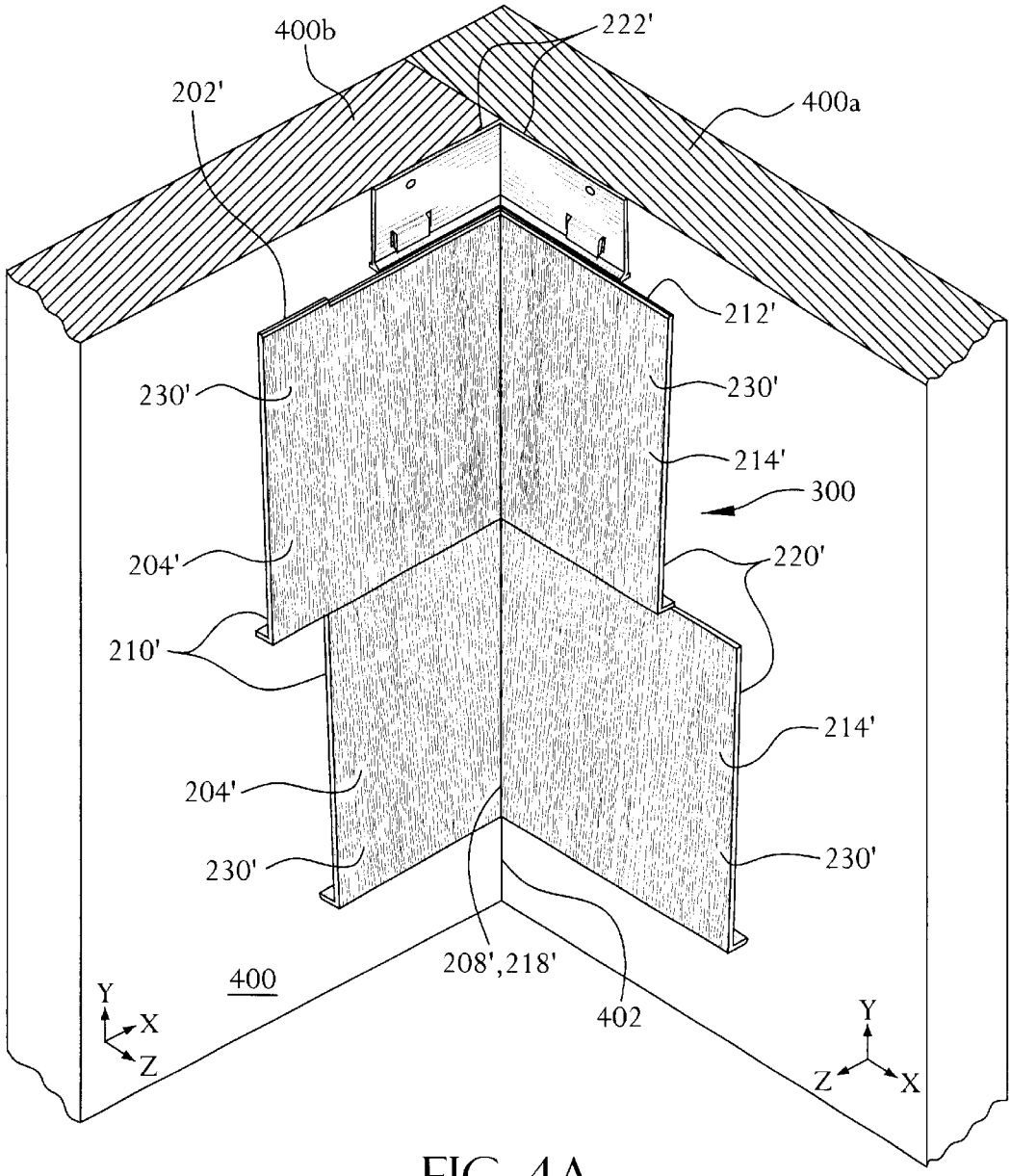
FIG. 4A is a front perspective view of an exemplary inside corner piece according to the present invention.
Figure 4B:
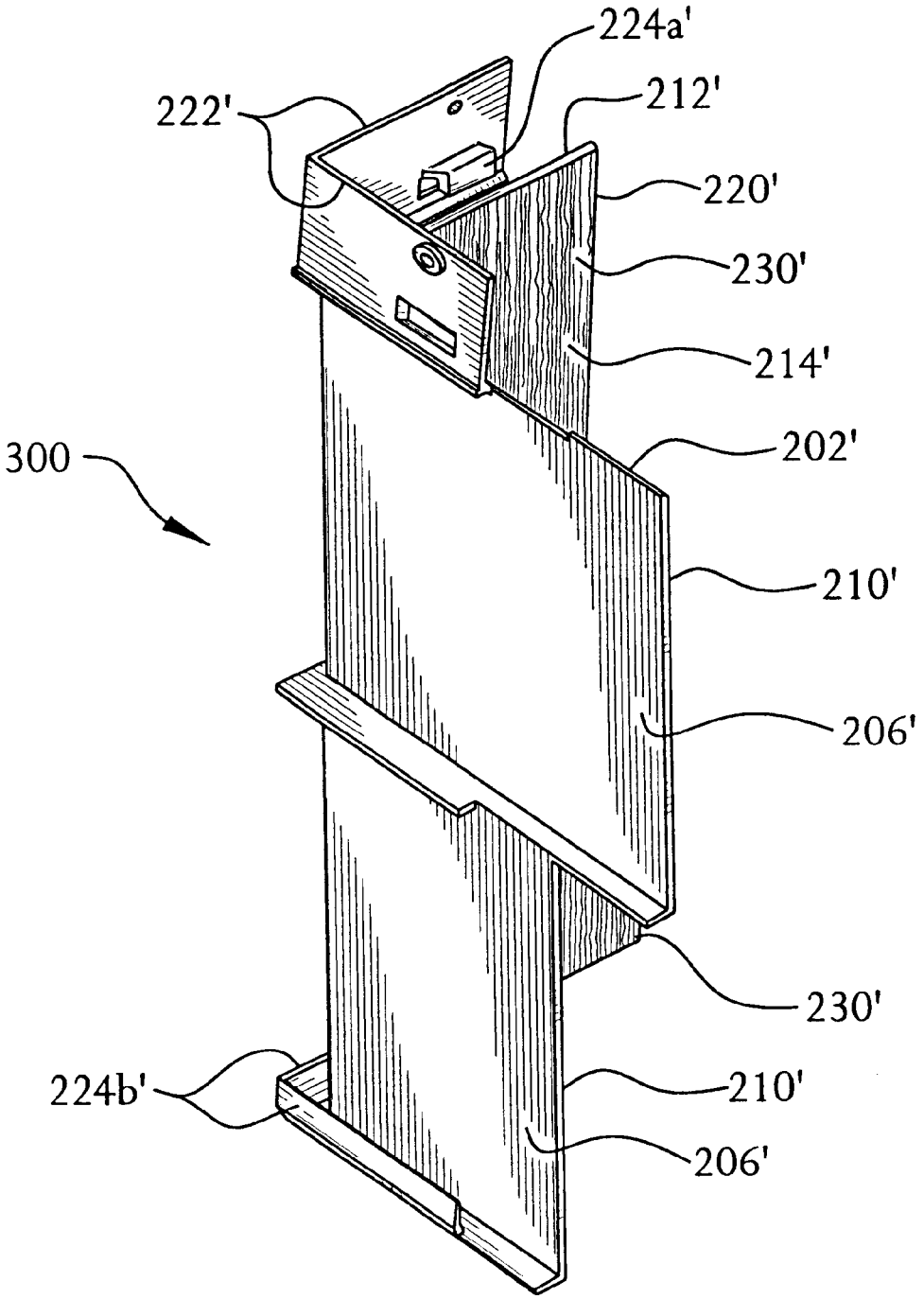
FIG. 4B is a side perspective view of the exemplary corner piece of FIG. 4A.
Figure 4D:
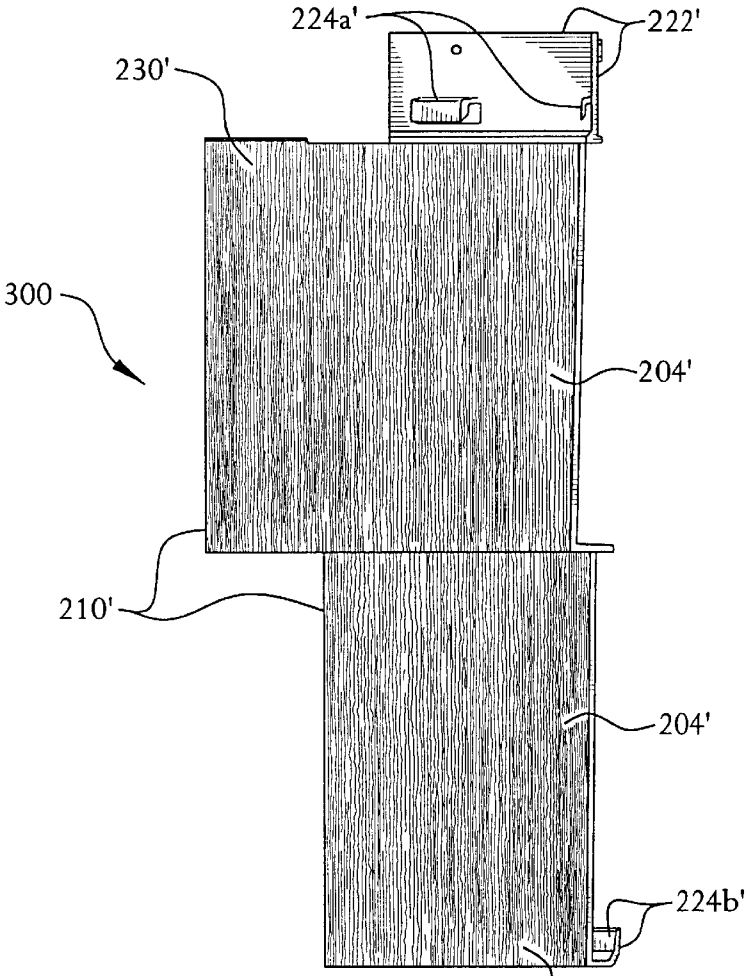
FIG. 4D is a second side elevational view of the exemplary corner piece of FIG. 4A.
Figure 4C:
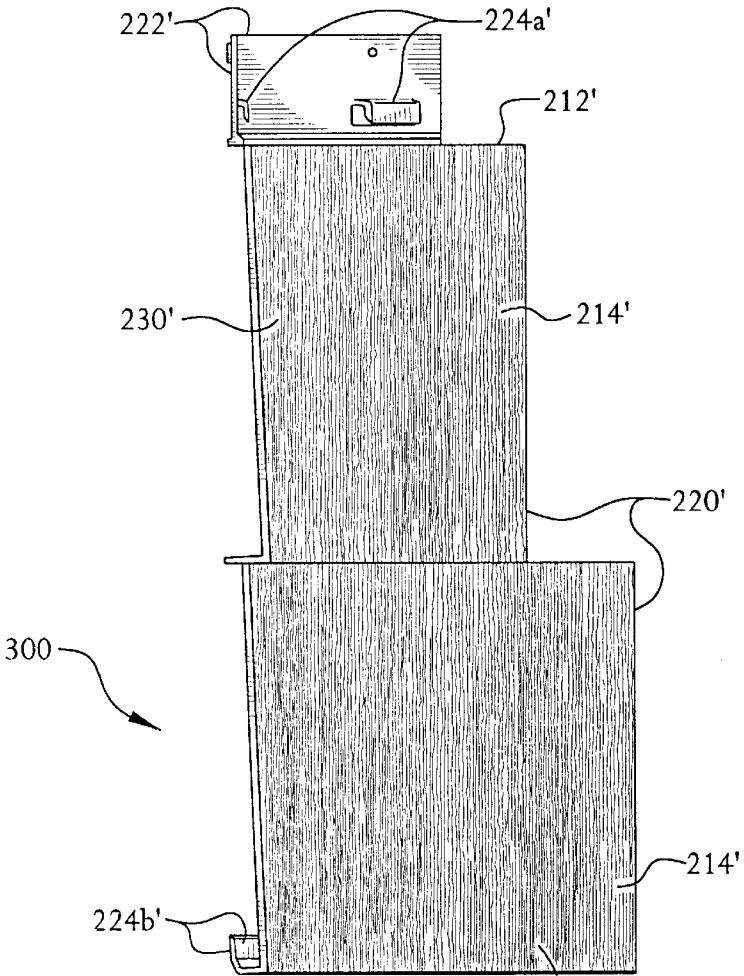
FIG. 4C is a first side elevational view of the exemplary corner piece of FIG. 4A.
Figure 4E:
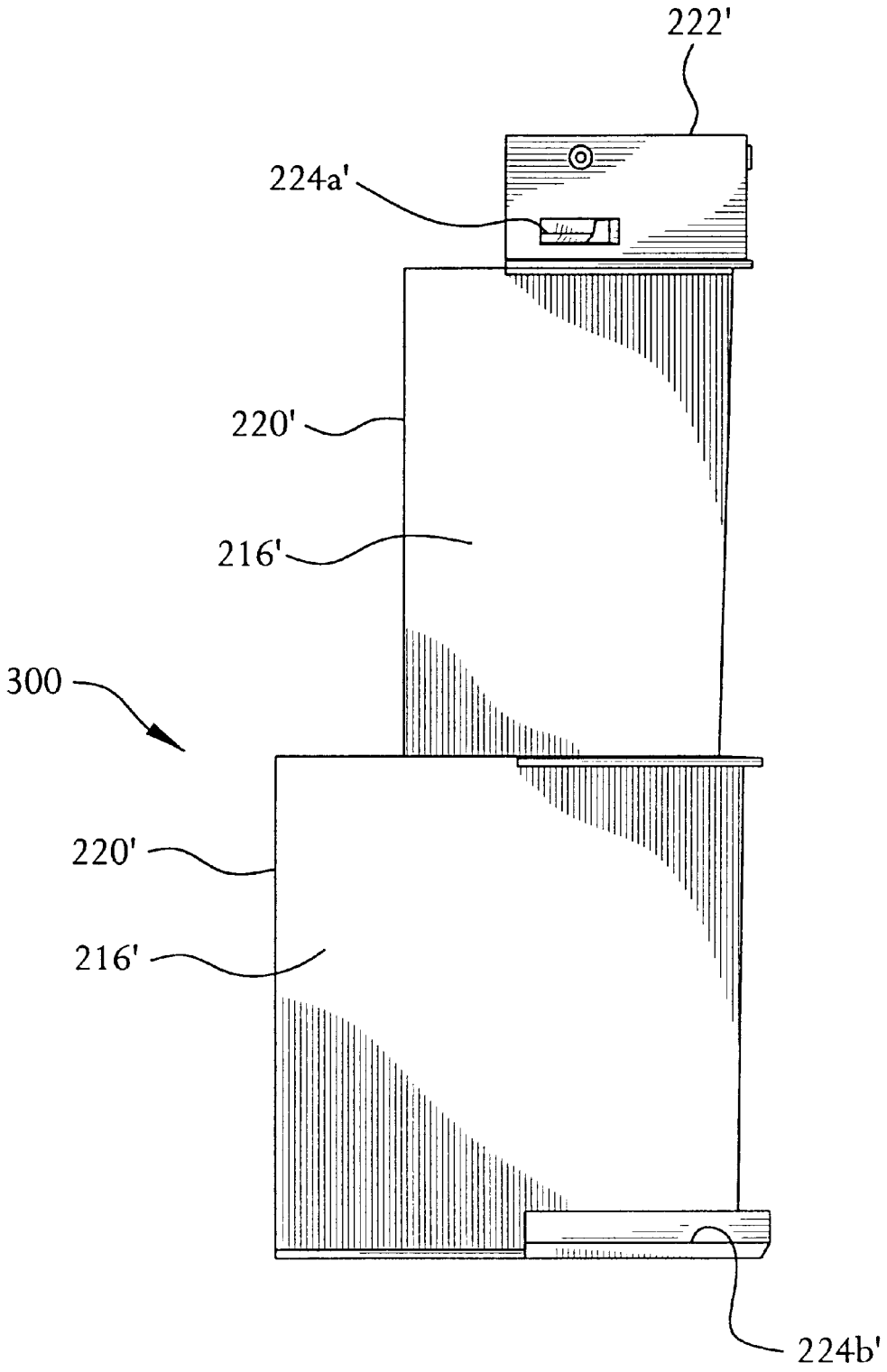
FIG. 4E is an inside side elevational view of the exemplary corner piece of FIG. 4A.

FIGS. 4A through 4E illustrate an exemplary interior corner piece 300. The reference numbers of FIGS. 4A through 4E correspond to the features of exemplary outside corner piece 200 described above, only with a prime following each reference number. Referring specifically to FIG. 4A, the inside corner piece 300 is shown secured to a structure 400 (shown in partial) including first and second mating walls 400*a*, 400*b*, respectively, that mate to define a corner of the structure including vertical corner 402. Each wall 400*a*, 400*b* has an exterior face defined in the horizontal X-vertical Y plane, and a thickness of each wall is defined in the Z direction perpendicular to the respective X-Y plane. FIG. 4A clearly shows the horizontal offset in the X direction of the second lateral edges 210' (and 220') of an adjacent pair of vertically stacked shingle impressions 230' relative to the common corner of the corner piece 300 defined by the mating of the first lateral edges 208' and 218' and also relative to the vertical corner 402 of the structure 400.

Although various embodiments have been illustrated, this is for the purpose of describing, and not limiting the invention. Various modifications will become apparent to one skilled in the art and are within the scope of this invention described in the attached claims. For example, the exterior faces of the siding corners may include an ornamental appearance containing a plurality of vertically stacked siding impressions that are brick, slate, masonry or other siding impressions designed to match the courses formed on the siding panels attached to the structure.

We claim:

1. A corner piece for covering a corner of a structure defined by two mating walls of said structure and for use in conjunction with siding panels containing multiple shingle impression courses fastened to said mating walls, each of said mating walls having an exterior face defined in the horizontal X-vertical Y plane, with a thickness of said wall being defined in the Z direction perpendicular to the X-Y plane, said corner piece comprising:

a first group of vertically stacked shingle impressions and a second group of vertically stacked shingle impressions, each shingle impression in said first and second groups including an exterior face and an interior face and a first lateral edge and a second lateral edge opposite said first lateral edge, said first group and second group meeting at a common corner defined by said first lateral edges, said second lateral edges of an adjacent pair of said vertically stacked shingle impressions in at least one of said groups being offset from each other in the X direction when said corner piece is secured to the corner of said structure, wherein said shingle impressions of said at least one group overlap at least a portion of said siding panels when said siding panels and said corner piece are fastened to said structure, whereby said shingle impressions and said multiple shingle impression courses of said siding panels cooperate to give the appearance that said corner piece substantially blends into said siding panels.

2. The corner piece of claim 1, further comprising fastening means for attaching said corner piece to said structure, said fastening means disposed such that said corner piece is detachable from said corner of said structure without removing said siding panels from said walls of said structure when said siding panels and said corner piece are fastened to said structure.

3. The corner piece of claim 2, wherein said fastening means is a nailing flange disposed at a top end of at least one of said first and second groups.

4. The corner piece of claim 1, further comprising cooperable catch means for securing a pair of said corner pieces to each other along said corner of said structure, said cooperable catch means disposed to secure a bottom end of a first one of said pair to a top end of a second one of said pair.

5. The corner piece of claim 1, wherein said corner piece is injection molded.

6. The corner piece of claim 5, wherein said corner piece is formed from polyvinyl chloride or polypropylene.

7. The corner piece of claim 1, wherein said corner piece is an inside corner piece.

8. The corner piece of claim 1, wherein said corner piece is an outside corner piece.

9. The corner piece of claim 1, wherein a bottom edge of a first one of said vertically stacked shingle impressions in said at least one group is offset in the Z-direction from a top edge of a second one of said vertically stacked shingle impressions in said at least one group disposed below said first one to give the appearance that said bottom edge overlaps said top edge.

10. A molded corner piece for covering a corner of a structure defined by two mating walls of said structure and for use in conjunction with siding panels containing multiple shingle impression courses fastened to said mating walls, each of said mating walls having an exterior face defined in the horizontal X-vertical Y plane, with a thickness of said wall being defined in the Z direction perpendicular to the X-Y plane, said corner piece comprising:

a first group of vertically stacked shingle impressions and a second group of vertically stacked shingle impressions, each shingle impression in said first and second groups including an exterior face and an interior face and a first lateral edge and a second lateral edge opposite said first lateral edge, said first group and second group meeting at a common corner defined by said first lateral edges, said second lateral edges of an adjacent pair of said vertically stacked shingle impressions in at least one of said groups being offset from each other in the X direction when said corner piece is secured the corner of said structure, wherein said shingle impressions of said at least one group overlap at least a portion of said siding panels when said siding panels and said corner piece are fastened to said structure, whereby said shingle impressions and said multiple shingle impression courses of said siding panels cooperate to give the appearance that said corner piece substantially blends into said siding panels; and fastening means for attaching said corner piece to said structure, said fastening means disposed such that said corner piece is detachable from said corner of said structure without removing said siding panels from said walls of said structure when said siding panels and said corner piece are fastened to said structure.

11. The corner piece of claim 10, further comprising cooperable catch means for securing a pair of said corner pieces to each other, said cooperable catch means disposed to secure a bottom end of a first one of said pair to a top end of a second one of said pair.

12. The corner piece of claim 10, wherein said fastening means is a nailing flange disposed at a top end of at least one of said first and second walls.

13. The corner piece of claim 10, wherein said corner piece is formed from polyvinyl chloride or polypropylene.

14. The corner piece of claim 10, wherein said corner piece is an inside corner piece.

15. The corner piece of claim 10, wherein said corner piece is an outside corner piece.

16. The corner piece of claim 10, wherein a bottom edge of a first one of said vertically stacked shingle impressions in said at least one group is offset in the Z direction from a top edge of a second one of said vertically stacked shingle impressions in said at least one group disposed below said first one to give the appearance that said bottom edge overlaps said top edge.

17. An injection molded corner piece for covering a corner of a structure defined by two mating walls of said structure and for use in conjunction with siding panels containing multiple shingle impression courses fastened to said mating walls, each of said mating walls having an exterior face defined in the horizontal X-vertical Y plane, with a thickness of said wall being defined in the Z direction perpendicular to the X-Y plane, said corner piece comprising:

a first group of vertically stacked shingle impressions and a second group of vertically stacked shingle impressions, each shingle impression in said first and second groups including an exterior face and an interior face and a first lateral edge and a second lateral edge opposite said first lateral edge, said first group and second group meeting at a common corner defined by said first lateral edges, said second lateral edges of an adjacent pair of said vertically stacked shingle impressions in at least one of said groups being offset from each other in the X direction when said corner piece is secured to the corner of said structure, wherein said shingle impressions of said at least one group overlap at least a portion of said siding panels when said siding panels and said corner piece are fastened to said structure, whereby said shingle impressions and said multiple shingle impression courses of said siding panels cooperate to give the appearance that said corner piece substantially blends into said siding panels;

a nailing flange for securing said corner piece to said structure disposed such that said corner piece is detachable from said corner of said structure without removing said siding panels from said walls of said structure when said siding panels and said corner piece are fastened to said structure; and a cooperable catch means for securing a pair of said corner pieces to each other, said cooperable catch means disposed to secure a bottom end of a first one of said pair to a top end of a second one of said pair.

18. The corner piece of claim 17, wherein said corner piece is an inside corner piece.

19. The corner piece of claim 17, wherein said corner piece is an outside corner piece.

20. The corner piece of claim 17, wherein said corner piece is formed from polyvinyl chloride or polypropylene.

21. The corner piece of claim 17, wherein a bottom edge of a first one of said vertically stacked shingle impressions in said at least one group is offset in the Z direction from a top edge of a second one of said vertically stacked shingle impressions in said at least one group disposed below said first one to give the appearance that said bottom edge overlaps said top edge.

22. A corner piece for covering a corner of a structure defined by two mating walls of said structure and for use in conjunction with siding panels containing multiple shingle impression courses fastened to said mating walls, said corner piece comprising:

a first group of vertically stacked shingle impressions and a second group of vertically stacked shingle impressions meeting at a common corner, wherein at least one of said first and second groups comprises upper and lower lateral edges each located a distance from the common corner along a wall of the structure, one of the upper and lower lateral edges being located closer to the common corner than the other of the upper and lower lateral edges to define a horizontal offset between the upper and lower lateral edges, wherein said shingle impressions overlap at least a portion of said siding panels when said siding panels and said corner piece are fastened to said structure, whereby said shingle impressions and said multiple shingle impression courses of said siding panels cooperate to give the appearance that said corner piece substantially blends into said siding panels.

23. The corner piece of claim 22, wherein a bottom edge of a first one of said vertically stacked shingle impressions in said at least one group is offset from a top edge of a second one of said vertically stacked shingle impressions in said at least one group to give the appearance that said bottom edge overlaps said top edge.

24. A corner piece for covering a vertical corner of a structure defined by two mating walls of said structure and for use in conjunction with siding panels containing multiple shingle impression courses fastened to said mating walls, said corner piece comprising:

a first group of vertically stacked shingle impression and a second group of vertically stacked shingle impressions meeting at a common corner, wherein at least one of said first and second groups comprises upper and lower lateral edges each located a horizontal distance from the vertical corner along a wall of the structure when said corner piece is secured to cover the vertical corner of said structure, one of the upper and lower lateral edges being located closer to the vertical corner than the other of the upper and lower lateral edges to define a horizontal offset between the upper and lower lateral edges, wherein said shingle impressions overlap at least a portion of said siding panels when said siding panels and said corner piece are fastened to said structure, whereby said shingle impressions and said multiple shingle impression courses of said siding panels cooperate to give the appearance that said corner piece substantially blends into said siding panels.

25. The corner piece of claim 24, wherein a bottom edge of a first one of said vertically stacked shingle impressions in said at least one group is offset from a top edge of a second one of said vertically stacked shingle impressions in said at least one group to give the appearance that said bottom edge overlaps said top edge.

* * * * *